US009782965B2

(12) United States Patent
Hoffman, Jr. et al.

(10) Patent No.: US 9,782,965 B2
(45) Date of Patent: Oct. 10, 2017

(54) PRINTING MACHINE WITH SHUTTLE ASSEMBLY

(71) Applicant: M&R Printing Equipment, Inc., Glen Ellyn, IL (US)

(72) Inventors: Richard C. Hoffman, Jr., Lake Forest, IL (US); Boguslaw W. Magda, Wheaton, IL (US); Bernabe Christopher Mauban, Hanover Park, IL (US)

(73) Assignee: M&R Printing Equipment, Inc., Roselle, IL (US)

( * ) Notice: Subject to any disclaimer, the term of this patent is extended or adjusted under 35 U.S.C. 154(b) by 190 days.

(21) Appl. No.: 14/012,528

(22) Filed: Aug. 28, 2013

(65) Prior Publication Data

US 2014/0060350 A1 Mar. 6, 2014

Related U.S. Application Data

(60) Provisional application No. 61/694,112, filed on Aug. 28, 2012, provisional application No. 61/715,049, filed on Oct. 17, 2012.

(51) Int. Cl.

| | |
|---|---|
| ***B41F 15/02*** | (2006.01) |
| ***B41F 17/00*** | (2006.01) |
| ***B41F 15/08*** | (2006.01) |

(52) U.S. Cl.

CPC ..... *B41F 17/005* (2013.01); *B41F 15/02* (2013.01); *B41F 15/0863* (2013.01); *B41F 17/003* (2013.01)

(58) Field of Classification Search

CPC ..... B41F 17/003; B41F 17/005; B41F 15/02; B41F 15/0863; B41J 3/4078; B41J 3/4073

See application file for complete search history.

(56) References Cited

U.S. PATENT DOCUMENTS

| | | | | |
|---|---|---|---|---|
| 4,873,643 | A * | 10/1989 | Powell | B41C 1/145 345/632 |
| 5,129,161 | A | 7/1992 | Szarka | |
| 5,301,608 | A | 4/1994 | Szarka et al. | |
| 5,575,206 | A | 11/1996 | Szyszko | |
| 5,845,569 | A | 12/1998 | Tkacz et al. | |
| 5,943,953 | A | 8/1999 | Oleson | |
| 5,953,987 | A | 9/1999 | Oleson | |
| 7,837,286 | B2 * | 11/2010 | Kofman | A01J 27/005 347/4 |
| 2006/0152568 | A1 * | 7/2006 | Niimi et al. | 347/104 |
| 2008/0238978 | A1 * | 10/2008 | Niimi | 347/16 |

(Continued)

*Primary Examiner* — Leslie J Evanisko
(74) *Attorney, Agent, or Firm* — Nixon Peabody LLP

(57) ABSTRACT

In an embodiment of the present invention, a number printing machine is provided. The machine includes at least one pallet, and an input to input at least the height and width of, and spacing between, a plurality of numbers to be printed on a substrate. The machine also includes a controller responsive to the input to control movement of the at least one pallet to print the plurality of numbers on the substrate in registration. In another embodiment, a method for printing numbers in registration on a substrate is provided. The method includes the steps of inputting into an input the length, width, and spacing between numbers to be printed, and positioning the substrate in response to the input such that the numbers are printed in registration.

9 Claims, 7 Drawing Sheets

(56) References Cited

U.S. PATENT DOCUMENTS

| | | | | |
|---|---|---|---|---|
| 2009/0180153 | A1* | 7/2009 | Noonan | G06Q 30/02 358/3.29 |
| 2010/0000429 | A1* | 1/2010 | Hoffman et al. | 101/123 |
| 2010/0092677 | A1* | 4/2010 | Ozawa | 427/275 |
| 2011/0109686 | A1* | 5/2011 | McDowell | A43B 3/0078 347/20 |
| 2011/0242189 | A1* | 10/2011 | Okada et al. | 347/20 |

* cited by examiner

PRINTING MACHINE WITH SHUTTLE ASSEMBLY

CROSS-REFERENCE TO RELATED APPLICATIONS

The present Application claims the benefit of U.S. Provisional Application No. 61/694,112 filed Aug. 28, 2012, and U.S. Provisional Application No. 61/715,049 filed Oct. 17, 2012, the contents of which are incorporated herein by reference.

FEDERALLY SPONSORED RESEARCH OR DEVELOPMENT

N/A

TECHNICAL FIELD

The present invention generally relates to screen printing machines, and in particular to an improved manual printing machine with an associated shuttle assembly capable of moving and registering one or more pallets supporting a textile to be printed upon more accurately for printing multiple images on the textile, such as multiple numbers or letters and/or outlines/enhancements to the numbers or letters.

BACKGROUND OF THE INVENTION

Printing numbers on substrates, such as textiles, in perfect registration is very important. Numbers and letters must be properly registered for them to be properly aligned next to one another. And if additional indicia, such as an outline or border of the number or letter, is to be printed, it must be registered in conjunction with the number or letter. The printing machine of the present invention uses an add-on shuttle assembly. This shuttle assembly controls the movement and registration or positioning of the pallets supporting the textile. It permits one to print numbers or letters in registration with each other and around or adjacent each one automatically once given the dimensions of the numbers or letters and/or the desired spacing therebetween.

SUMMARY OF THE INVENTION

In an embodiment of the present invention, a multiple indicia manual printing machine is provided that includes an add-on shuttle assembly. The shuttle assembly includes at least one pallet, and an input device for inputting at least the height and width of, and spacing between, a plurality of numbers or letters to be printed on a substrate. The machine also includes a controller responsive to the input to control movement and positioning of the at least one pallet to print the plurality of numbers on the substrate in registration.

In another embodiment, a method for printing numbers and/or their outlines in registration on a substrate is provided. The method includes the steps of inputting into an input the length, width, and spacing between numbers to be printed, and positioning the substrate in response to the input such that the numbers are printed in registration.

BRIEF DESCRIPTION OF THE DRAWINGS

To understand the present invention, it will now be described by way of example, with reference to the accompanying drawings in which.

DETAILED DESCRIPTION

Figure 1:
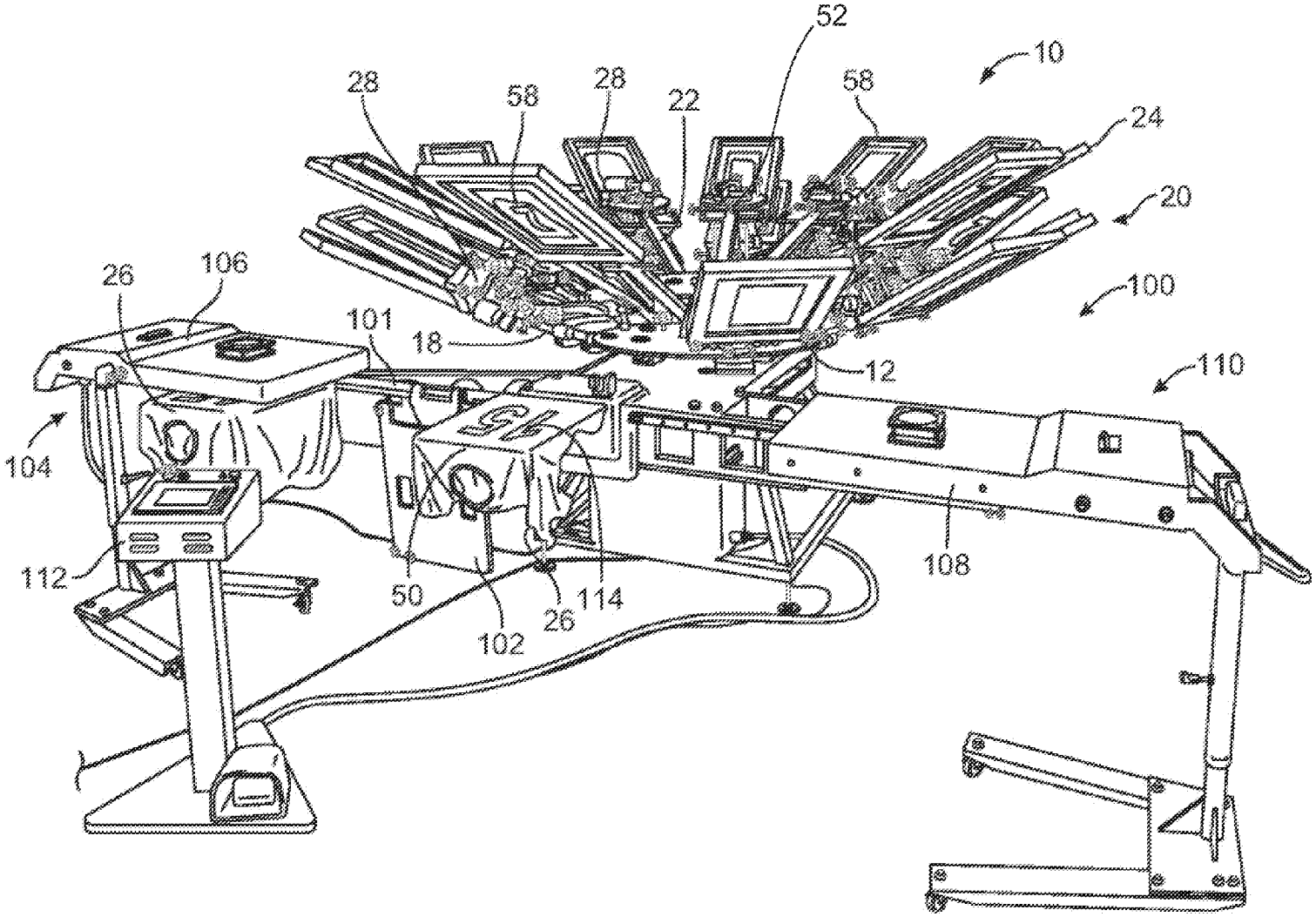
FIG. 1 is a perspective view of a manual printing machine with the accompanying shuttle assembly made in accordance with an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the Figures, a printing machine 10 in accord with an embodiment of the present invention is shown. The printing machine 10 can be generally of the type described in U.S. Pat. No. 5,845,569 to Tkacz, et al., assigned to the assignee of the current application, and incorporated herein by reference.

The printing machine 10 is preferably a multi-tiered turret style manual printing machine and is shown as having a centrally located turret 12, or base section, that is stationary when in use. This base section 12 can include wheels to move it to different locations for use thereof. The base section 12 supports a plurality of radially spaced apart printing head supporting arms 18 (forming the first tier 20), and radially spaced apart second or auxiliary printing head supporting arms 22 (forming the second tier 24). The second tier 24 is positioned above the first tier 20. In general, each of the supporting arms 18 and 22 spoke radially outwardly from the base section 12. Well-known and successful machines of this type are sold by M&R Printing Equipment. Glen Ellyn, Ill. under the trademark ABACUS™ or CHAMELEON™.

The printing machine 10 of FIG. 1 includes ten printing head supporting arms 18 with each supporting a printing head 28, and ten secondary or auxiliary printing head supporting arms 22 with each supporting a printing head 28. Each deck 20,24 has capacity for ten screens 58, one for each of the numbers 0-9. Alternatively, one of the first and second decks 20 and 24 can include other indicia, such as outlining for the numbers 0-9. Additionally, while not shown, it is understood the specific movement of each tier 20,24 described herein can include that of any tier described. In addition, while printing numbers are discussed, the teachings of the present invention can encompass letters, designs and any indicia desired to be printed on a substrate, such as a textile.

The printing machine 10 also incorporates a means for selectively bringing either a first tier printing head supporting member 18 or a second tier printing head supporting member 22 towards a pallet 26. As such, the printing head supporting arms 22 of the first tier 18 are adapted for movement relative to the pallet 26 for alignment therewith. This permits a screen 58 secured to a printing head 28, attached generally to a distal end of at least one printing head supporting arm of the first tier 18, to cooperate with a substrate 50 resting on the pallet 26. Similarly, the printing head supporting arms of the second tier 22 are adapted for movement relative to the pallet 26 for alignment therewith. This also permits a screen 58 secured to a printing head 28, attached generally to a distal end 52 of at least one printing head supporting arm of the second tier 22, to cooperate with a substrate resting on a pallet 26. Thus, a textile on a pallet 26 can be printed upon by movement (rotation), alignment, and registration (discussed below) of each of the printing heads 28 from both tiers 20,24.

As described in the above-mentioned movements, both the printing head supporting arms 18 and the auxiliary printing head supporting arms 22 are moveable in at least two radial planes, each plane normal to one another. The two planes in which the printing head supporting arms 18,22 are moveable include: (1) a horizontal plane about the base section; and, (2) a vertical plane about the base section. The arms 18,22 are moveable in a horizontal plane by the rotatable collar (not shown) connected to each arm 18,22. And, the arms 18,22 are moveable in a vertical plane by a hinge assembly (not shown) disposed on the arm 18,22.

The distal ends of the first and second tiers 20,24 of the printing head supporting members support printing heads 28. A typical printing head 28 includes well known and conventional components such as a screen 58, a flood bar (not shown) and a squeegee (not shown). By automatic or manual means the flood bar and squeegee of a print station operate to print an image, in a single color, on the substrate resting upon the pallet 26. As a result, by using multiple screens, the printing on the substrates or textiles can include many different numbers, letters or other indicia, such as an accent outline to the letters or numbers, and controlled automatically or manually.

A shuttle assembly, generally shown at 100, can be attached or positioned adjacent the printing machine 10 such the pallets to be printed upon pass below the print head that does the printing. This shuttle assembly controls the movement and positioning of the pallets carrying the textiles. The shuttle preferably moves the pallets to either a print position or a non-print or cure position.

The shuttle assembly includes a rail 101 preferably attached to the base 12 of the printing machine 10. Movably attached to the rail 101 are one or more pallets 26 which are meant to support the textile to be printed upon. The pallets 26 travel transversely along the rail 101. Preferably, on the rail, each pallet 26 will travel or cycle between a curing zone (at one or each of the ends of the rail) and a printing zone, wherein the textile resting on the pallet will be printed on. The transverse movement of the pallets 26 is controlled or indexed using at least one servo motor (not shown).

In setting-up the position of the pallets 26 relative to the print heads, a registration pallet 102 can be used. This registration pallet can be attached to the rail 101 and moved into or out of position when needed to align and register the screens relative to the pallets. The registration pallet 102 is preferably of the type disclosed in U.S. Pat. No. 5,953,987 to Oleson, assigned to M&R Printing Equipment, Inc., Glen Ellyn, Ill., and incorporated herein by reference. Registration of each of the printing heads 28 and screens 58 using the registration pallet 102 permits the printing heads and screens 28,58 to be lowered to the same position each time, assuring alignment or registration of numbers and/or other indicia to be printed on the substrate 50 and relative to each other.

At a first end 104 of the rail 101 is a curing station 106. The curing station 106 can selectively cure ink from numbers printed on the substrate 50, and can be any suitable curing unit available in the art. A second curing station 108 can also be located at a second end 110 of the rail 101. Use of a second curing station 108 permits ink on a substrate 50 on one pallet 26 to be cured while the substrate 50 on the other pallet is being printed upon. Accordingly, the pallets 26 can shuttle between the curing zones and the printing zone. Thus while a first pallet supporting a substrate is in the printing zone and being printed upon, a second pallet can be in a second curing zone at an end of the rail. While the second pallet supporting a substrate is in the printing zone and being printed upon, the first pallet can be in a first curing zone at the other end of the rail. Two pallets and two curing stations can have the following cycle:

| Position of First Pallet | Position of Second Pallet |
|---|---|
| In Printing Zone | At Second Cure Station |
| Moving from Printing Zone to First Cure Station | Moving from Second Cure Station to Printing Zone |
| At First Cure Station | In Printing Zone |
| Moving from First Cure Station to Printing Zone | Moving from Printing Zone to Second Cure Station |
| In Printing Zone | At Second Cure Station |

Figure 2:
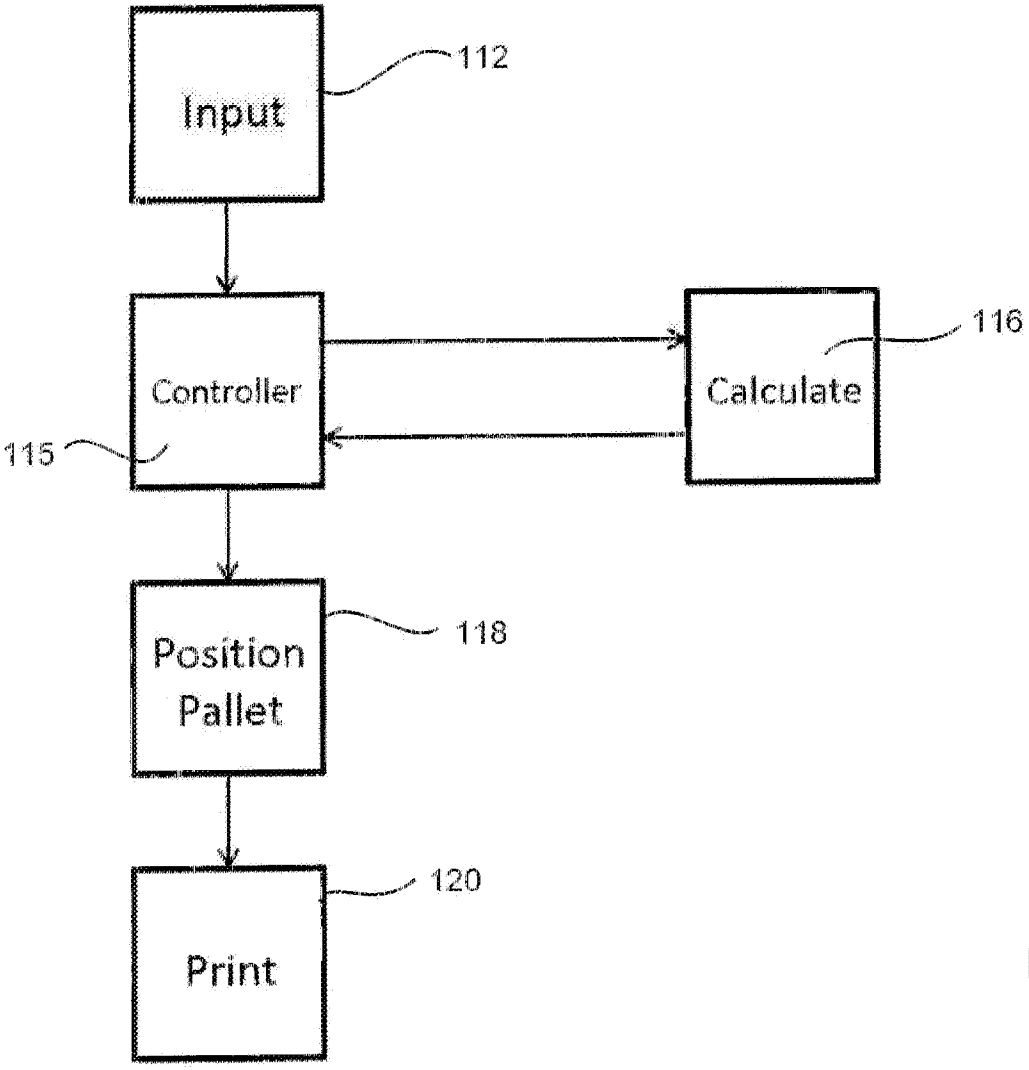
FIG. 2 is a schematic flowchart of a method for printing in accordance with the machine and shuttle of FIG. 1.

The method of the present invention is shown schematically in FIG. 2. An input 112 allows a user of the printing machine 10 to select the numbers 114 to be printed onto the substrate 50 (See FIG. 5). The input 112 put into an input device also allows the user to select the dimensions of the numbers 114 to be printed, namely their height and width using, for instance, a touchscreen keypad 113 (See FIGS. 5-8). Additionally, the input allows the user to input the desired distance between the numbers 114 (See FIGS. 5-8).

Figure 5:
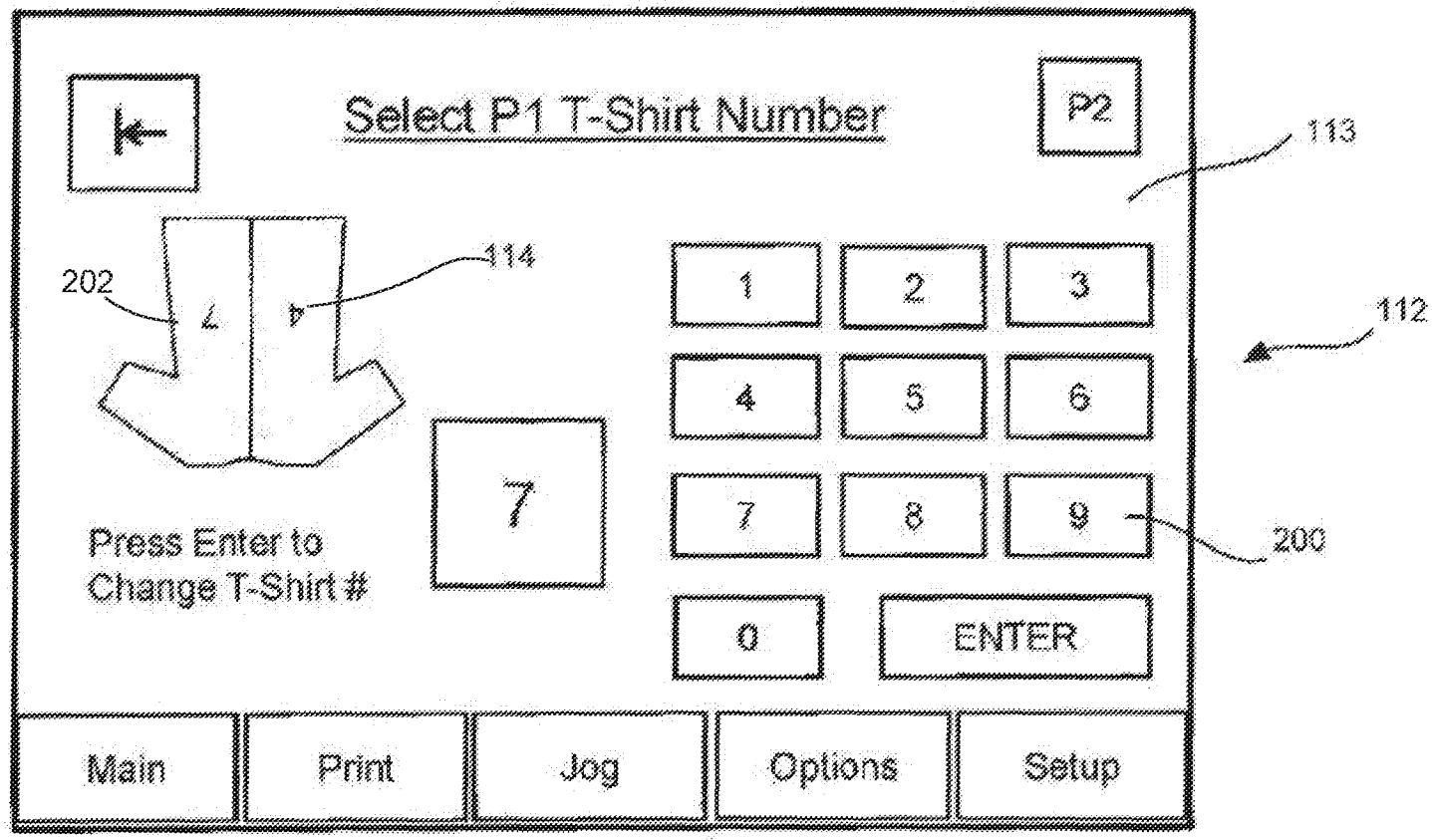
FIG. 5 is a representation of a screen shot showing an input for printing with the machine and shuttle of FIG. 1.

FIG. 5 shows an input 112 to select numbers 114 to be printed on the substrate. The user presses the number keys 200 to input a selected number 114. The number 114 is shown on the T-Shirt icon 202. Different numbers 114 can be selected for each pallet 26.

Similarly, dimensions can be inputted into the input 112 for the numbers 114. A screen 204 (FIG. 7) shows the selected number widths 206 and number height 208. Likewise, the gap or spacing 209 between numbers 114 can be selected using input 112. A screen 210 showing the selected parameters for a print job is shown in FIG. 6.

Figure 6:
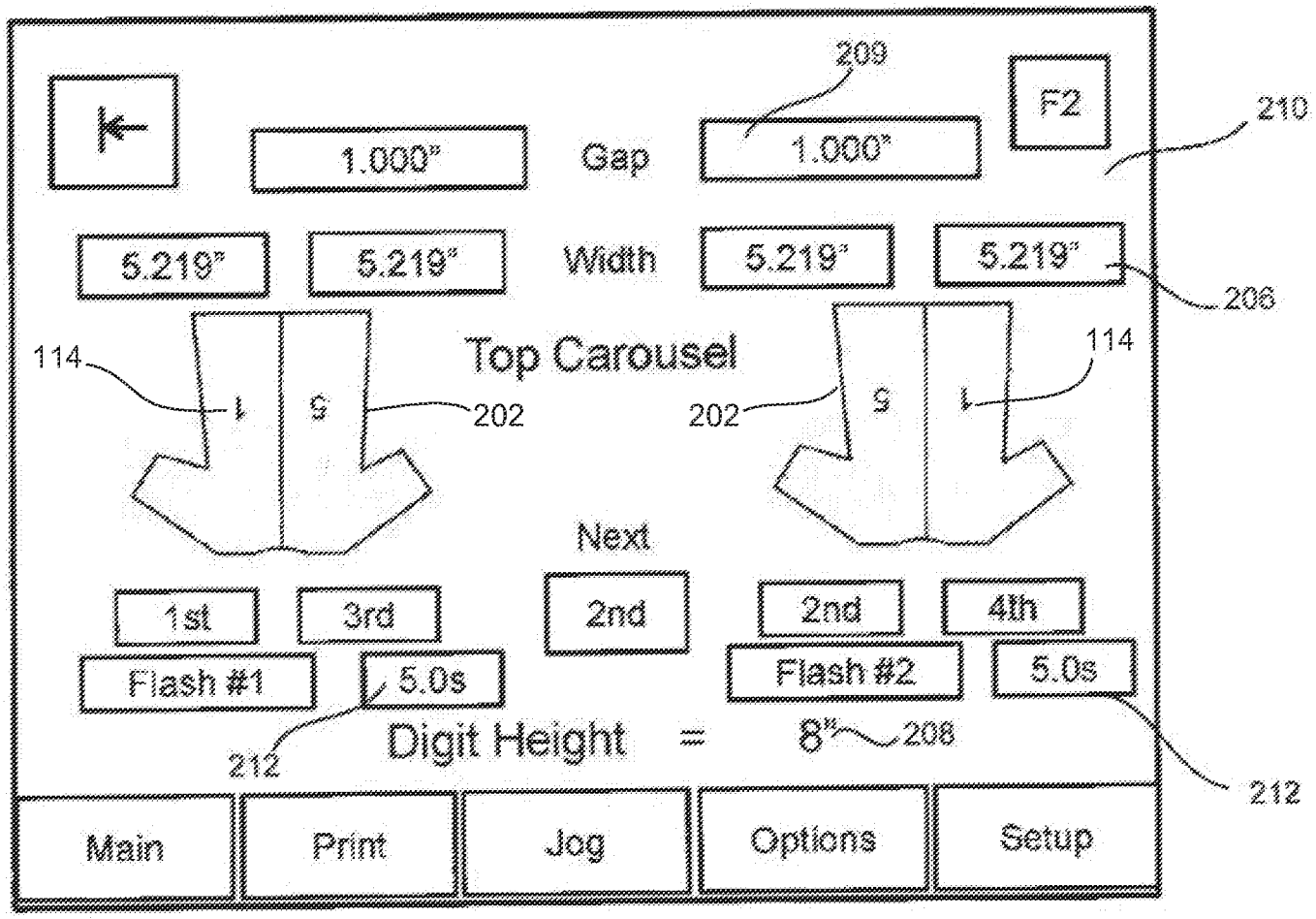
FIG. 6 is another representation of a screen shot showing an input for printing with the machine and shuttle of FIG. 1.
Figure 7:
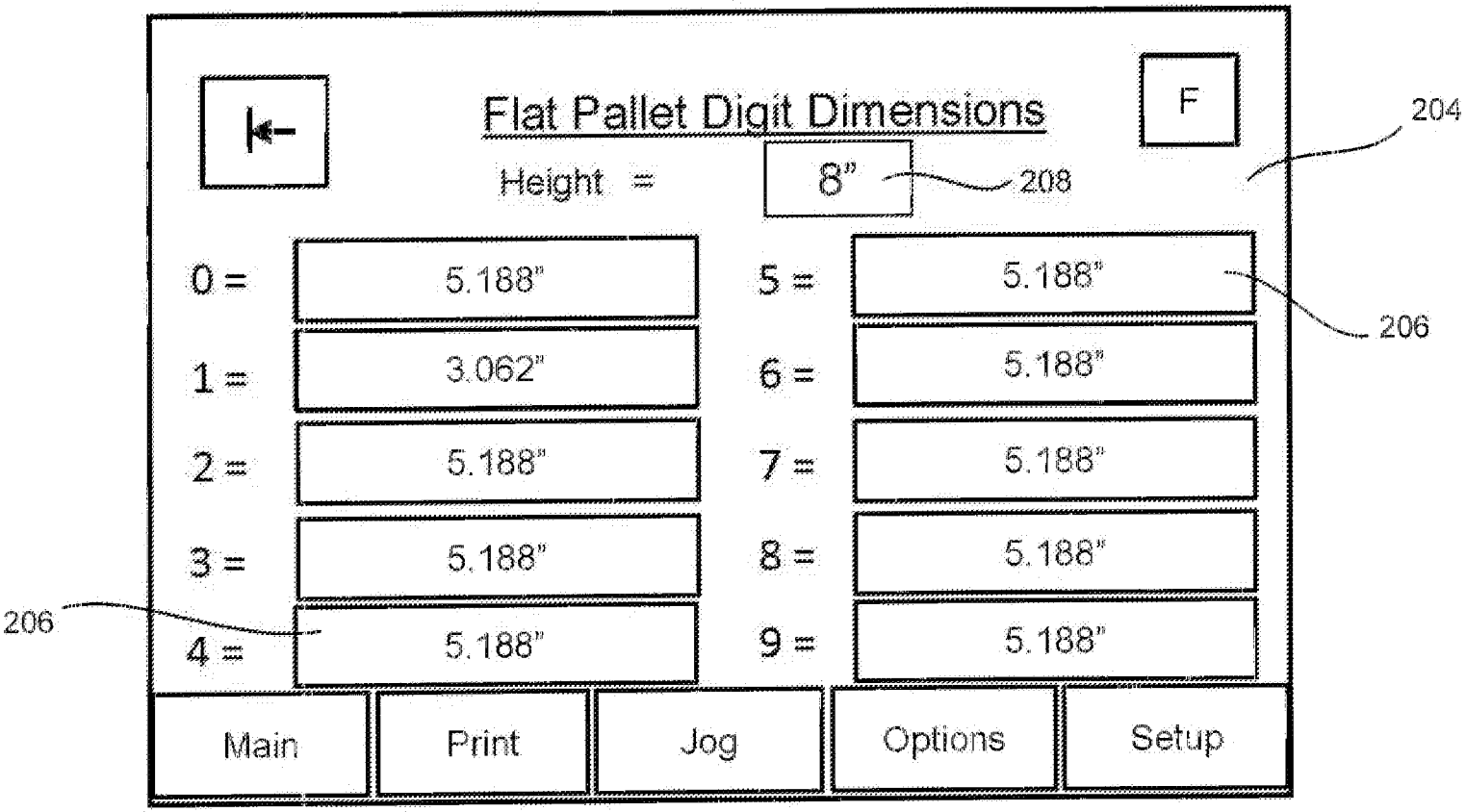
FIG. 7 is a further representation of a screen shot showing an input for printing with the machine and shuttle of FIG. 1.

FIG. 6 shows the selected gap or spacing 209 between selected numbers 114, the height 208 and widths 206 of the selected numbers 114, as well as selected curing or flash times 212 at each of the curing stations 106, 108.

Figure 8:
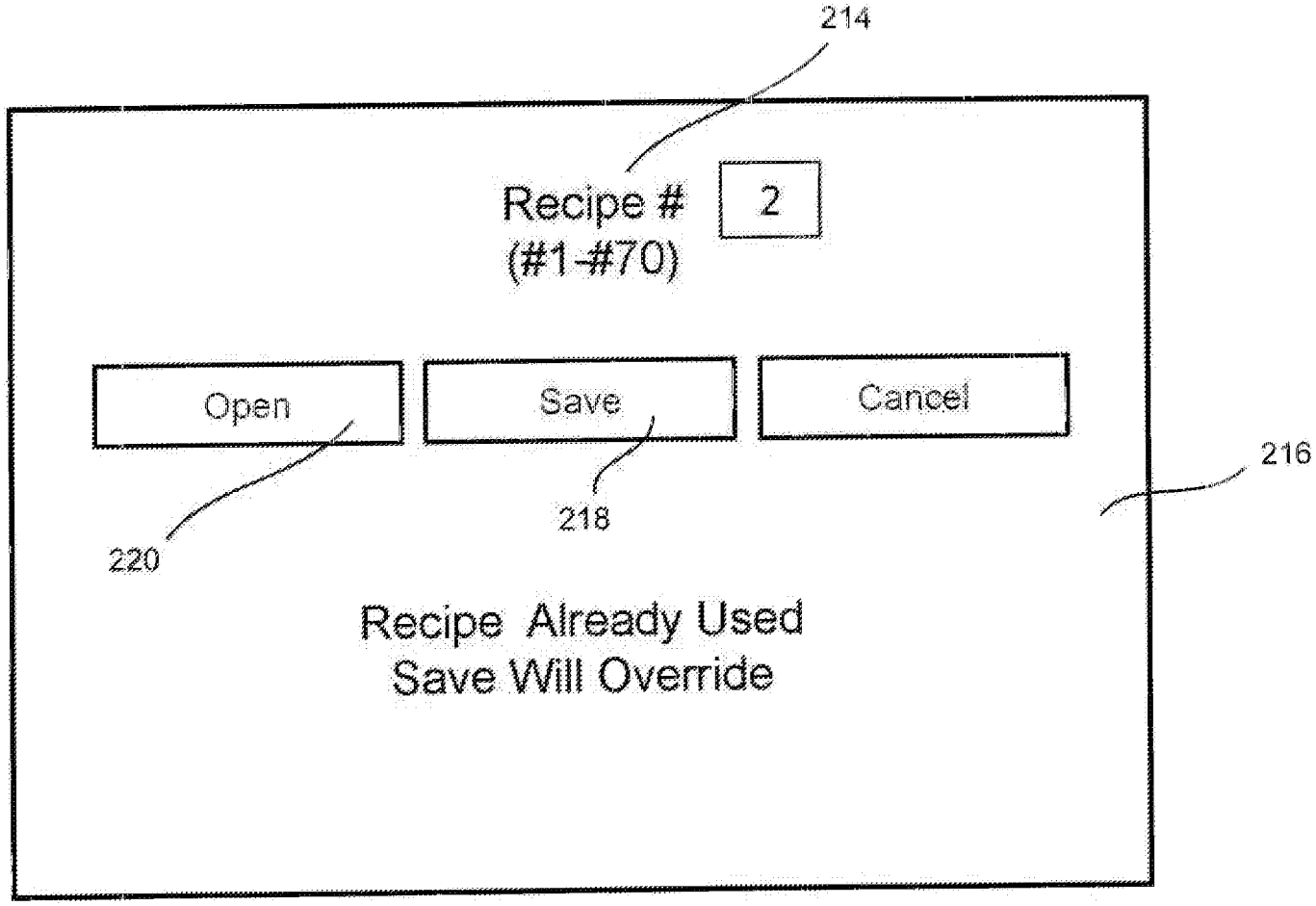
FIG. 8 is a still further representation of a screen shot showing an input for printing with the machine and shuttle of FIG. 1.

Additionally, as shown in FIG. 8, the selected parameters for a print job may be saved as recipes 214 for future print jobs at input screen 216. A number of recipes 214 can be saved 218 and opened or recalled 220 for future reference and without having to re-input all of the parameters.

A controller 115 receives the input from the input 112 and controls movement of the servo motor to transversely move and position 118 the pallets 26 along the rail 101 in response to the input. The controller 115 can be programmed to calculate 116 the movement of the servo motor in response to the input 112, or the movements can be predetermined and programmed into a memory in the controller 115. Once the pallet 26 is in position, the substrate 50 may be printed upon manually by moving the screen of the print head immediately adjacent the substrate on the pallet and printing thereon.

Figure 4:
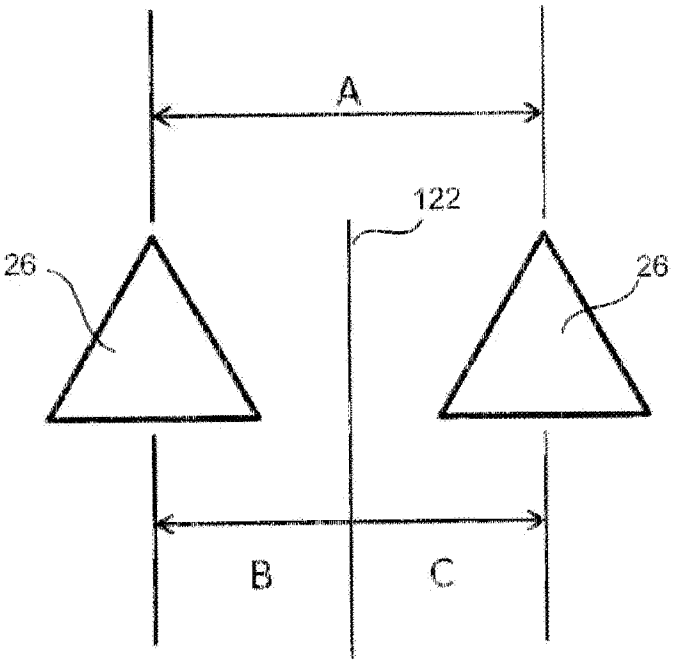
FIG. 4 is a schematic drawing for printing with the method shown in FIG. 3.

The movement of the pallets 26 can be determined from using a pre-determined centerline 122 between the pallets 26 set by the registration pallet 102, and calculating the distance each pallet 26 must travel (B and C) for the numbers 114 to be in registration based on the dimensions of and distance between the numbers, shown schematically in FIG. 4.

Figure 3:
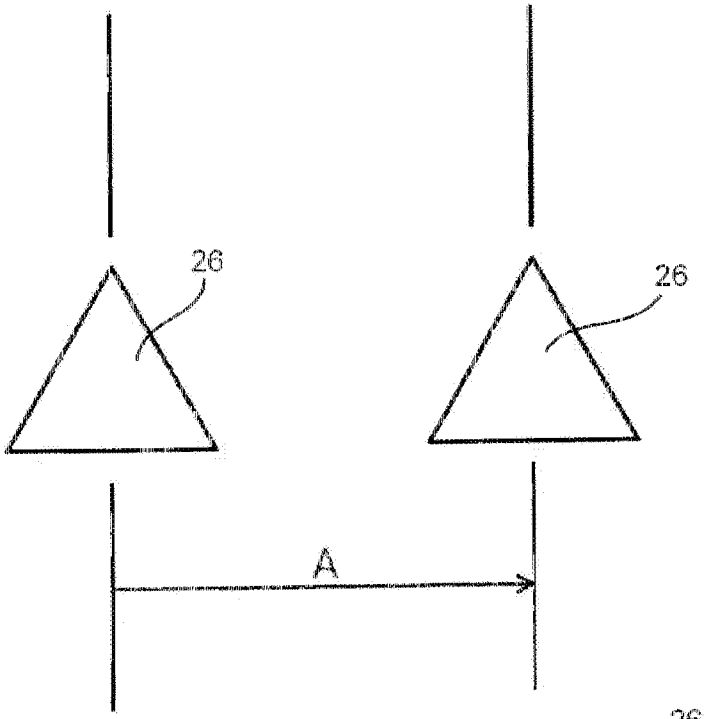
FIG. 3 is a schematic drawing of one method for printing with the machine and shuttle of FIG. 1.

Alternatively, the distance from one pallet to the second pallet can be calculated by the controller, and the pallet 26 moved the appropriate distance A by the servo motor for the numbers to print 120 in registration based on the dimensions of and distance between the numbers 114, shown schematically in FIG. 3.

In a preferred embodiment, the controller 115 can adjust the pallets' movement to compensate for kerning when the number "1" is printed. The number "1" is obviously a thinner number than the other numbers.

In another embodiment, the means for selectively bringing either a first tier printing head supporting member 18 or a second tier printing head supporting member 22 to the pallet 26 can include a servo motor controlled by the controller 115 through input 112. An operator can input into input 112 the desired number or numbers to be printed, for instance "15." In response to the input 112, the servo motor moves the screen 58 containing the number "1" to the pallet 26 such that it cooperates with substrate 50 on pallet 26. The servo motor also brings the screen 58 containing the number "5" to the pallet 26 such that it cooperates with the substrate 50 on pallet 26. The screens are registered using registration pallet 102 as described above.

In particular the screens supporting the numbers can be manually moved into position or moved into position automatically by a controller 115 as requested by the operator through the input 112.

While the specific embodiments have been illustrated and described, numerous modifications come to mind without significantly departing from the spirit of the invention, and the scope of protection is only limited by the scope of the accompanying Claims.

What is claimed is:

1. A printing machine comprising:

at least one pallet for supporting a textile to be printed on and mounted for movement along a rail by a motor between a print zone and a curing zone;

a plurality of print heads extending radially from a central hub having an axis of rotation and the print heads being moveable about the axis in a common horizontal plane into and out of the print zone;

a print head from the plurality of print heads is located in the printing zone and positioned above the pallet and moveable from a printing position to a non-printing position;

an input having a graphical user interface having fields for a user to input a number for printing on the textile and at least a height and a width of the number to be printed on the textile and a gap between adjacent digits of the number;

an output of the graphical user interface showing an icon representing the textile with the number on the icon, and a field showing the height dimension, the width dimension and the gap dimension; and a controller responsive to the input to control movement of the at least one pallet using the motor to move the at least one pallet transversely on the rail to print the number on the textile having the height, width and gap.

2. The printing machine of claim 1 further comprising at least one curing station in the curing zone.

3. The printing machine of claim 1 wherein the at least one pallet comprises two pallets.

4. The printing machine of claim 1 wherein the number comprises two digits.

5. The printing machine of claim 1 wherein the input is a touch screen.

6. The printing machine of claim 1 wherein at least one of the print heads of the plurality of print heads has indicia to be printed on the textile.

7. The machine of claim 1 wherein the graphical user interface further comprises a field for a user to enter a curing time.

8. The machine of claim 1 wherein the graphical user interface further comprises a field for a user to save a user selected set of parameters for a print job as a recipe.

9. The machine of claim 1 wherein the graphical user interface further comprises a field for a user to select a recipe from a plurality of recipes.

* * * * *